US010294781B2

(12) United States Patent
Frith et al.

(10) Patent No.: US 10,294,781 B2
(45) Date of Patent: May 21, 2019

(54) COMPENSATOR, THRUST BEARING AND TORSION BAR FOR SERVO-DRIVEN MUD PULSER

(71) Applicant: Gordon Technologies LLC, Lafayette, LA (US)

(72) Inventors: Benjamin G. Frith, Lafayette, LA (US); Terrence G. Frith, Lafayette, LA (US)

(73) Assignee: Gordon Technologies, LLC, Scott, LA (US)

( * ) Notice: Subject to any disclaimer, the term of this patent is extended or adjusted under 35 U.S.C. 154(b) by 0 days.

(21) Appl. No.: 15/997,484

(22) Filed: Jun. 4, 2018

(65) Prior Publication Data

US 2018/0347350 A1 Dec. 6, 2018

Related U.S. Application Data

(60) Provisional application No. 62/514,605, filed on Jun. 2, 2017.

(51) Int. Cl.

| | |
|---|---|
| ***E21B 47/16*** | (2006.01) |
| ***E21B 47/18*** | (2012.01) |
| *E21B 34/06* | (2006.01) |

(52) U.S. Cl.

CPC ..... *E21B 47/182* (2013.01); *E21B 47/187* (2013.01); *E21B 34/066* (2013.01)

(58) Field of Classification Search

CPC ..... E21B 47/182; E21B 47/187; E21B 34/066
USPC ..... 367/84
See application file for complete search history.

(56) References Cited

U.S. PATENT DOCUMENTS

| | | | | |
|---|---|---|---|---|
| 6,016,288 | A | 1/2000 | Frith | |
| 9,133,950 | B2 | 9/2015 | Gopalan et al. | |
| 9,464,521 | B2 | 10/2016 | Logan et al. | |
| 9,528,370 | B2 | 12/2016 | Logan et al. | |
| 2007/0104030 | A1 | 5/2007 | Kusko et al. | |
| 2010/0215301 | A1 | 8/2010 | Wenzel | |
| 2014/0124693 | A1* | 5/2014 | Gopalan | E21B 47/182 251/359 |
| 2015/0167466 | A1* | 6/2015 | Teodorescu | E21B 47/01 175/40 |
| 2015/0377018 | A1* | 12/2015 | Lee | E21B 47/182 340/854.3 |

(Continued)

OTHER PUBLICATIONS

International Search Report and the Written Opinion of the International Searching Authority issued in related application No. PCT/US2018/35895 dated Aug. 24, 2018 (6 pages).

*Primary Examiner* — Tanmay K Shah
(74) *Attorney, Agent, or Firm* — Zeman-Mullen & Ford, LLP

(57) ABSTRACT

A pressure compensator assembly is deployed in a servo-driven mud pulser. The assembly includes a generally tubular compensator sleeve that expands and contracts in a radial direction in order to compensate for pressure differentials across the compensator sleeve. A thrust bearing arrangement is also deployed in a servo-driven mud pulser, the thrust bearing arrangement designed to protect the servo motor from reactive energy caused by servo motor stalls as the motor changes direction of rotation. A torsion bar is deployed in a drill string to protect fragile components and electronics in the drill string by absorbing and smoothing out torsion spikes in the drill string arising from stick-slip events.

16 Claims, 7 Drawing Sheets

(56) References Cited

U.S. PATENT DOCUMENTS

2017/0284194 A1* 10/2017 Logan ..... E21B 47/182

* cited by examiner

COMPENSATOR, THRUST BEARING AND TORSION BAR FOR SERVO-DRIVEN MUD PULSER

RELATED APPLICATIONS

This application claims the benefit of, and priority to, commonly-invented and commonly-assigned U.S. Provisional Patent Application Ser. No. 62/514,605, filed Jun. 2, 2017. The entire disclosure of 62/514,605 is incorporated herein by reference.

FIELD OF THE DISCLOSURE

This disclosure is directed generally to subterranean drilling technology, and more specifically to improvements to conventional servo-driven mud pulser designs. All of the disclosed improvements enhance the reliability of pulser units for Measurement-While-Drilling (MWD) data transmission during downhole operations.

BACKGROUND OF THE DISCLOSED TECHNOLOGY

Starting in about 1985, oilfield service companies began using retrievable "MWD" (Measurement While Drilling) systems in downhole subterranean drilling environments. Such MWD systems typically provide borehole sensor electronics and mud pulse transmitters to transmit downhole numerical data in "real time" to the earth's surface via mud pulse telemetry.

Conventional designs of mud pulse transmitters ("pulsers") in MWD systems may include a servo valve (or "pilot valve") to control a larger main valve. For example, U.S. Pat. No. 6,016,288 ("the '288 patent") discloses a pulser in which a battery powered on-board DC electric motor ("servo motor") is used to operate a servo valve. The servo valve in turn adjusts internal tool fluid pressures to cause operation of a main valve (or "transmitter valve") to substantially reduce mud flow to a drill bit, thereby creating a positive pressure surge detectable at the surface. De-energizing the servo motor results in readjustment of internal fluid pressures, causing the main valve to reopen, thereby terminating the positive pressure surge. Enablement and termination of a positive pressure surge creates a positive pressure pulse detectable at the surface. Streams of pressure pulses may be encoded to transmit data.

The servo motor in older designs such as described in the '288 patent typically rotates in one direction only, responsive to activating pulses of DC voltage. FIG. 2A in the '288 patent illustrates the disclosed assembly in a default resting position, with the servo motor inactive and the servo valve closed. FIG. 2B in the '288 patent illustrates the disclosed assembly after the servo motor has been energized to open the servo valve to its fully open position. Controls associated with the servo motor detect when the servo valve is fully open and cause the servo motor to shut off. Spring bias in the disclosed assembly, assisted by internal differential mud pressure, cause the servo valve to close again as the disclosed assembly returns to the resting position per FIG. 2A.

More recent designs of servo-driven mud pulsers have configured the servo motor to drive both the opening and the closing of the servo valve. The servo motors in these designs are thus disposed to rotate in both directions. The improved mud pulser of the instant disclosure is such a design. Controls associated with the servo motor detect when the servo valve is fully open and fully closed, usually by detecting a current spike in the servo motor when the servo valve reaches a fully open or fully closed position and can travel no further in that direction. Detection of the current spike causes the servo motor to change direction of rotation. This sequence is depicted generally in FIG. 10 and will be described in more detail further on in this disclosure.

Compensator

Pulsers according to any of the above-described designs typically collocate the servo motor and servo valve in a servo assembly. The servo assembly thus has both electrical and mechanical components, functioning together to open and close the servo valve. The orifice in the servo valve must allow drilling fluid to flow through its opening, since the fluid serves as the hydraulic medium by which the servo assembly controls operation of the transmitter valve. However, the servo motor and other electrical components of the servo assembly must also be sealed off from the drilling fluid in order to prevent the fluid (which is typically electrically conductive) from adversely affecting the operation of the servo motor. In particular, the drilling fluid should be prevented from contacting and shorting out the electrically-powered actuator in the servo assembly. (Typically the actuator includes a lead screw whose rotation in either direction by the servo motor causes corresponding extension and retraction of a pulser shaft into and out of the orifice in the servo valve). The sealed off area for electrical components is typically termed the "oil chamber" because once sealed, it is preferably filled with an electrically non-conductive, incompressible fluid, such as oil.

Oil chamber designs must be able to compensate for significant changes in external pressure and temperature as the drill string bores into the Earth. As the string bores deeper, the ambient drilling fluid pressure and temperature around the oil chamber will increase. As the ambient drilling fluid pressure increases, the oil chamber will tend to experience volume decrease even though the oil in the chamber is deemed "incompressible". (It will be appreciated that the term "incompressible" is a term of art rather than an absolute parameter, allowing for some small degree of compressibility). Moreover, as the ambient drilling fluid temperature increases, the oil in the chamber will tend to expand. Failure to compensate for these volumetric changes inside the oil chamber can create a pressure differential across the oil chamber seal between the oil inside the chamber and the drilling fluid outside the chamber. Such a pressure differential results in the actuator having to work harder and thus potentially drawing more current than for which it is designed. This can cause a significant decrease in life of the actuator and ultimately the servo motor. The pressure differential can become so great that the actuator can no longer overcome it, causing the actuator to lock up. The pulser will cease to function until the pressure differential is relieved.

Pressure compensation in the oil chambers described above thus becomes an important design concern in developing robust and dependable mud pulsers. There are at least two currently known pressure compensator assembly designs, each of which has its drawbacks. The first (and most common) prior art design is a compensating piston, as shown generally on FIG. 1. On FIG. 1, and responsive to an actuator (not illustrated), a pulser shaft 101 reciprocates into (broken lines) and out of (unbroken lines) an orifice 102 in servo valve 103. Compensating piston 104 is disposed to move within sleeve 108. Pulser shaft 101 reciprocates through an opening in the center of compensating piston 104, and the reciprocation of pulser shaft 101 is independent of any movement of compensating piston 104 within sleeve 108. Compensating piston 104 separates the oil chamber 105 from the drilling fluid 106. Dynamic seals (such as o-rings) 107A and 107B respectively maintain separation of oil chamber 105 and drilling fluid 106 by sealing the interfaces between compensating piston 104 and sleeve 108, and between compensating piston 104 and pulser shaft 101. As oil in the oil chamber 105 wants to expand due to temperature or compress due to pressure, compensating piston 104 will move accordingly in sleeve 108, allowing the oil volume to change as needed.

The drawback with the compensator design per FIG. 1 is that solids in the drilling fluid 106 on the environment side of compensating piston 104 often cause the piston to get stuck in the sleeve 108. Once stuck, compensating piston 104 loses its ability to compensate. As noted above, failure to compensate the oil chamber 105 generally will allow a pressure differential to build between the oil in the chamber and the ambient drilling fluid, eventually causing the actuator to lock up and the pulser to cease functioning. Further, solids around the compensating piston 104 in the prior art design of FIG. 1 may cause seals 107A and 107B to deteriorate, in turn causing leakage of drilling fluid 106 around the compensator piston 104 into the oil chamber 105. The oil will now become electrically conductive, potentially causing the actuator to short out.

A second known (prior art) pressure compensator assembly design for oil chambers is shown generally on FIGS. 2A and 2B. This second design provides a bladder 209 instead of dynamic seals 107A and 107B on FIG. 1 to separate oil in the oil chamber (205 on FIGS. 2A and 2B) from drilling fluid (206 on FIGS. 2A and 2B).

Referring to FIGS. 2A and 2B, and responsive to an actuator (actuator housing 211 partially illustrated), a pulser shaft 201 reciprocates into (FIG. 2A) and out of (FIG. 2B) an orifice 202 in servo valve 203. Pulser shaft 201 is rigidly connected to end cap 212. Seal rings 210 sealingly secure bladder 209 to actuator housing 211 at one end of bladder 209, and to end cap 212 at the other end of bladder 209. As noted, bladder 209 separates oil in the oil chamber 205 from drilling fluid 206. Bladder 209 comprises a deformable material (typically a rubber) that inflates or deflates in response to changes in oil volume in oil chamber 205. Bladder 209 also "accordions" back and forth as servo shaft 201 retracts from and extends into orifice 202.

The drawback with the compensator design per FIGS. 2A and 2B is that in order for the bladder 209 to accordion back and forth without tearing, it must be very thin. Thin rubber is prone to cyclic wear and rupture, particularly at the "corners" of the accordion. Further, the washing of solids in the drilling fluid flow past the bladder can also cause wear and rupture. When the bladder does rupture, the electrically-conductive drilling fluid floods the oil chamber, shorting out the actuator and other electrical parts of the servo assembly.

There is therefore a need in the art for a pulser design that includes an oil chamber pressure compensator assembly that addresses the drawbacks of existing designs. There is a need in the art for more robust, dependable, long-life pressure compensation in oil chambers in servo-driven pulsers.

Dampening of Concussive Spikes from Servo Motor Stalls

As described generally above, more recent designs of servo-driven mud pulsers have configured the servo motor to drive both the opening and the closing of the servo valve by rotating the servo motor in both directions. As shown on FIG. 10, a detectable current spike in the DC supply to the servo motor occurs when the servo valve reaches a fully open or fully closed position and can travel no further in that direction. Detection of the current spike causes the servo motor to change direction of rotation.

A problem with this design occurs, however, when the servo valve reaches a fully open or fully closed position. The servo motor stalls momentarily until the drive current is switched and the servo motor rotates in the opposite direction. The stalling effect creates and transmits a reactive energy in the form of a concussive spike back through the servo assembly. If left unchecked this reactive energy can be transmitted through to the servo motor drive shaft and cause damage to the servo motor. In some cases, the reactive energy may jam the motor, even momentarily. Further, if the frictional force created by this jam is too great, the servo motor may not be able to release when trying to turn the opposite direction. This will cause a pulsing failure.

Some prior art designs remediate reactive energy from servo motor stalls by placing a small retaining ring feature on the servo motor drive shaft. The retaining ring feature intervenes to dampen reactive energy in the servo assembly from being transmitted back into the servo motor, and particularly into the planetary gearhead within the motor. In most cases, however, this retaining ring feature is inadequate. Being interposed between the servo motor drive shaft and the servo motor itself, the retaining ring is necessarily small and light so as not to affect torque delivered by the servo motor in normal operations. Over time, the retaining ring often proves not to be strong enough to withstand the repetitive reactive and concussive forces created each time the servo valve reaches a fully open or fully closed position. The retaining ring fatigues over time until failure.

There is therefore a need in the art for a pulser design that includes an improvement in the linkage between the servo assembly and the servo motor, in order to provide more robust dampening of the reactive energy generated in the servo assembly when the servo motor stalls to change direction.

Dampening of Torsion Spikes Created by Stick-Slip

"Stick-slip" is well understood term in subterranean drilling. The term refers to torsional vibration that arises from cyclical acceleration and deceleration of rotation of the bit, bottom hole assembly (BHA), and/or drill string during normal drilling operations. Stick-slip is particularly common when a selected bit is too aggressive for the formation, when a BHA is over-stabilized or its stabilizers are over-gauge, or when the frictional resistance of contact between the wellbore wall and the drill string interacts with the rotation of the drill string.

In the case of friction between the wellbore wall and the drill string, it will be understood that the drill string and bit both normally rotate in the clockwise direction when facing downhole, responsive to torque provided by a top drive and mud motor respectively. Contact between the drill string and the wellbore wall (whether casing or formation) thus imparts a corresponding counterclockwise friction force against the drill string and BHA components. A "micro-stall" occurs whenever the wellbore's counteracting friction force exceeds the local torque or rotational momentum of the drill string in frictional contact with the wellbore. A micro-stall may be only momentary or can last up to a minute. The result, however, is that torque builds up in the local drill string while the drill string is "stuck", until there is sufficient torque to overcome the frictional force causing the "stick". At that point, the drill string will release, or "slip". Such release events may be violent, often involving bursts of high rotational speed to normalize the torque and torsional deflection along a length of drill string. These release events create torsion spikes in the drill string that can be received in areas of the BHA containing sensitive and fragile MWD equipment. Exposure, and particularly prolonged exposure to these torsion spikes can damage the MWD equipment.

Servo-driven mud pulser designs such as described generally in this disclosure work closely with MWD equipment. Streams of longitudinal pulses created by the pulser in the drilling fluid (or "mud") are conventionally encoded to transmit data between the earth's surface and MWD equipment operating downhole. As a result, MWD equipment is typically located immediately above the mud pulser unit (i.e. nearer the surface). The MWD equipment and the pulser are typically collocated in the BHA, above the bit.

It would therefore be useful for a pulser design to include an improvement configured to protect the associated MWD equipment by dampening torsion spikes from stick-slip events occurring elsewhere on the drill string. Such an improvement would be particularly useful in dampening torsion spikes originating near the pulser and MWD equipment collocated in the BHA.

SUMMARY AND TECHNICAL ADVANTAGES

The needs in the art described above in the "Background" section are addressed by an improved oil chamber pressure compensator for the servo assembly, a thrust bearing arrangement to dampen concussive spikes from servo motor stalls, and a torsion bar to dampen torsion spikes caused by stick-slip events occurring elsewhere downhole.

This disclosure describes a new pressure compensator assembly. The assembly includes a generally tubular compensator sleeve that expands and contracts ("inflates" and "deflates") in a generally radial direction with respect to its cylindrical axis in order to compensate for pressure differentials across the compensator sleeve. The assembly is thus in distinction to the existing accordion-style bladder design described above, which displaces in a generally parallel direction with respect to the cylindrical axis. As a result, the drawbacks of the accordion design are avoided, primarily by enabling a thicker wall on the compensator sleeve that provides good wear resistance against passing abrasive solids in the drilling fluid flow, and good rupture resistance in response to repetitive loads.

The compensator sleeve in the new pressure compensator assembly further attaches at one end to a floating seal cap that slides over the servo shaft. The floating seal cap allows the pulser shaft to reciprocate back and forth operationally in the servo valve such that reciprocation of the pulser shaft causes only minimal disturbance and deformation of the compensator sleeve as the compensator sleeve compensates for pressure differentials. The floating seal cap is preferably sealed around the pulser shaft with a dynamic seal.

It should be noted that robust and dependable pressure compensator assemblies (such as the new assembly described in this disclosure) need not always be designed for the maximum operational life possible. The main adverse condition to be avoided is lock up or failure of the pulser during a drilling run. In some embodiments, compensator assemblies such as described in this disclosure may be designed for a service life to operate robustly between general maintenance cycles for the pulsers in which they are provided. Depending on the downhole service, this may be as frequently as one or two trips downhole. The compensator assembly may then be dismantled and inspected for wear and integrity during the general pulser maintenance, and components may be replaced or adjusted as required in order to re-establish optimum performance.

It is therefore a technical advantage of the disclosed new pressure compensator assembly to provide robust and dependable compensation of pressure differentials seen by the oil chamber in servo-driven pulsers. This in turn provides increased reliability for the pulser.

A further technical advantage is that the disclosed new compensator assembly avoids the thin-walled accordion-style bladders seen some in conventional designs. As a result, improved abrasive wear resistance and repetitive load failure resistance is seen by the thicker compensator sleeve wall provided.

A further technical advantage is that the disclosed new compensator assembly avoids the piston-sleeve assemblies seen in other conventional compensator designs. As noted above in the "Background" section, the piston-sleeve interface in such conventional designs is susceptible to solids buildup on the drilling fluid side of its dynamic seals, which buildup may eventually cause the piston to seize in the sleeve, and/or the seals to deteriorate and fail. Having no such piston-sleeve assembly, the disclosed new compensator assembly is more robust and dependable.

This disclosure further describes an improved servo assembly in which a thrust bearing arrangement directs reactive energy arising from servo motor stalls into the housing of the servo motor. In currently preferred embodiments, a thrust spacer and a thrust bearing are received over the rotor of the servo motor and are interposed, with snug contact, between a shoulder provided on the lead screw and the housing of the servo motor. As noted in the "Background" section above, repetitive stalls of the servo motor (as the servo valve reaches fully open and fully closed positions) generate reactive energy in the form of concussive spikes. The reactive energy transmits back through the servo linkage. The thrust spacer and thrust bearing arrangement described in this disclosure diverts such reactive energy from the servo linkage into the housing of the motor. By directing such reactive energy into the housing of the motor, the thrust bearing arrangement diverts such reactive energy away from the rotor of the motor, and isolates the rotor from such reactive energy.

It is therefore a technical advantage of the disclosed thrust bearing arrangement to divert reactive into the housing of the servo motor, the housing being is a relatively strong component that is far abler to absorb concussive spikes of reactive energy than the rotor. As a result, the service life of the servo motor is dramatically improved.

A further technical advantage of the disclosed thrust bearing arrangement is that absorption of the reactive energy by the housing tends to insulate the rotor (and the internal moving parts of the motor) from the reactive energy.

A further technical advantage of the disclosed thrust bearing arrangement is that the thrust bearing is a relatively wide diameter component with more surface area than, for example, a dampening element inserted in the rotor linkage as seen in the prior art. The reactive energy is thus absorbed in the thrust bearing as a lower overall stress per unit surface area.

This disclosure further describes a torsion bar inserted in the drill string to absorb torsion spikes caused be stick-slip events elsewhere on the drill string. In currently preferred embodiments, the torsion bar is located in the drill string to separate fragile components and electronics (such as MWD equipment, the servo motor, the servo assembly and the compensator assembly) from stick-slip events that may occur nearer the bit from such fragile equipment.

In preferred embodiments, the torsion bar may include portions made from a softer, more resilient material than the hard metal typically used for drill collar. Harder materials typically transmit torsion spikes, while softer materials absorb them better and smooth them out. Softer materials may include softer ferrous metals than typically used in the drill collar. Softer materials may also include aluminum, or a polymer. In preferred embodiments, the torsion bar also includes a reduced diameter portion. Materials science theory demonstrates that reducing the torsion bar's diameter is geometrically more effective in absorbing and smoothing out torsion spikes than increasing the length of the torsion bar. Reduced diameter is also one dimensional parameter which may be designed, along with material selection and other dimensional parameters, to develop a customized specification for the torsion bar to remediate anticipated torsion spike values expected on a particular job.

According to a first aspect, therefore, this disclosure describes embodiments of a compensator assembly in a downhole servo motor assembly, the compensator assembly comprising: a servo motor including a rotor and a motor housing, the servo motor received inside an elongate and tubular screen housing; a pulser shaft also received inside the screen housing, wherein rotation of the rotor in alternating directions causes corresponding reciprocating motion of the pulser shaft parallel to a longitudinal axis of the screen housing; a seal base also received inside the screen housing, the seal base received over the pulser shaft and affixed rigidly and seatingly to an interior wall of the screen housing; a compensator sleeve also received inside the screen housing, the compensator sleeve received over the pulser shaft; a seal cap also received inside the screen housing, the seal cap received over the pulser shaft, a dynamic seal also received over the pulser shaft and interposed between the seal cap and the pulser shaft such that the dynamic seal permits sealed sliding displacement between the seal cap and the pulser shaft; wherein a first end of the compensator sleeve is affixed sealingly to the seal base and a second end of the compensator sleeve is affixed sealingly to the seal cap such that an annular space is created between the compensator sleeve and the interior wall of the screen housing; wherein an oil chamber is bounded at least in part by the compensator sleeve and the seal cap, wherein oil in the oil chamber is sealed from commingling with at least (1) drilling fluid in the annular space, and (2) drilling fluid in a cavity sealed off from the oil chamber by the dynamic seal; wherein, responsive to pressure differential across the compensator sleeve between oil in the oil chamber and drilling fluid in the annular space and the cavity, the compensator sleeve contracts and expands in a radial direction perpendicular to the longitudinal axis of the screen housing; and wherein, responsive to said contraction and expansion of the compensator sleeve, the seal cap displaces along the pulser shaft while the oil chamber remains sealed during said seal cap displacement by the dynamic seal.

Embodiments of the compensator assembly may further comprise a jam nut, the jam nut received over the pulser shaft, the jam nut rigidly affixed to the seal cap such that the jam nut and the seal cap cooperate to retain the dynamic seal.

Embodiments of the compensator assembly may further comprise a first sealing ring, the first sealing ring sealing the first end of the compensator sleeve to the seal base. The first sealing ring may seal the first end of the compensator sleeve to the seal base via a sealing technique selected from the group consisting of (1) crimping, and (2) adhesive.

Embodiments of the compensator assembly may further comprise a second sealing ring, the second sealing ring sealing the second end of the compensator sleeve to the seal cap. The second sealing ring may seal the second end of the compensator sleeve to the seal cap via a sealing technique selected from the group consisting of (1) crimping, and (2) adhesive.

Embodiments of the compensator assembly may further comprise a compensator sleeve that is molded to at least one of the seal cap and the seal base.

According to a second aspect, this disclosure describes embodiments of a compensator assembly also comprising: a lead screw, the lead screw rotationally connected to the rotor within the screen housing, the lead screw providing an annular lead screw shoulder; a ball nut, the ball nut threadably engaged on the lead screw, the ball nut restrained from rotation with respect to the screen housing, the pulser shaft rigidly affixed to the ball nut at a first shaft end; a servo valve including an orifice, a second shaft end of the pulser shaft disposed to be received into the orifice; wherein said reciprocating motion of the pulser shaft is bounded by contact of the ball nut ultimately against the lead screw shoulder when the servo valve is fully open, and by contact of the second shaft end against the orifice when the servo valve is fully closed; wherein reactive energy is created from stalls of the servo motor, the stalls occurring when ball nut ultimately contacts the lead screw shoulder and when the second shaft end contacts the orifice; a thrust spacer and a thrust bearing, the thrust spacer and thrust bearing interposed between the lead screw shoulder and the motor housing such that the lead screw shoulder ultimately contacts the motor housing via at least the thrust spacer and thrust bearing; wherein the thrust spacer and thrust bearing divert the reactive energy into the motor housing.

Embodiments of the compensator assembly according to the second aspect may further comprise a bearing housing and at least one bearing that is interposed between the lead screw shoulder and the ball nut such that the ball nut ultimately makes contact against the lead screw shoulder via the bearing housing and the at least one bearing. In other embodiments according to the second aspect, a face plate may be attached to the motor housing such that the lead screw shoulder ultimately contacts the motor housing via at least the thrust spacer, the thrust bearing and the face plate. In other embodiments according to the second aspect, said rigid affixation of the pulser shaft to the ball nut at a first shaft end may be via a tubing adaptor.

According to a third aspect, this disclosure describes embodiments of a drill string section, the drill string section including a drill collar, the drill string further comprising: measurement-while-drilling (MWD) equipment; the compensator assembly according to the first aspect; and an elongate and tubular torsion bar inserted in the drill string, the torsion bar having (a) a length, (b) an external diameter, and (c) an internal diameter, the torsion bar further comprising at least one feature from the group consisting of: (1) the torsion bar comprises a softer material than used to form the drill collar; and (2) the torsion bar's length provides a reduced diameter portion thereof, the reduced diameter portion having a reduced external diameter.

Embodiments according to the third aspect may further comprise the compensator assembly according to the second aspect. In other embodiments, the reduced diameter portion may have a varying reduced external diameter. In other embodiments, portions of the torsion bar comprise a softer material than used to form the drill collar. In other embodiments, the torsion bar has a varying internal diameter.

It is therefore a technical advantage of the disclosed torsion bar to absorb and smooth out torsion spikes in arising the drill string as a result of stick-slip events. In this way, the torsion bar will protect fragile components and electronics in the drill string from such torsion spikes. It will nonetheless be understood that the design of the torsion bar is a trade-off between, on the one hand, remediation of torsion spikes in the drill string, and on the other hand, attendant disadvantages of inserting the torsion bar in the drill string. One such disadvantage is that when located between the MWD equipment and the bit, the torsion bar effectively moves the MWD equipment further away from the bit. All other considerations being equal, MWD equipment is preferably located as close to the bit as possible, in order to be as sensitive as possible to actual conditions at the bit. A further disadvantage is that reducing the diameter of at least a portion of the torsion bar, and/or making the torsion bar of softer or more resilient material, potentially weakens the torsion bar. Clearly the torsion bar cannot break or deform during service. A further disadvantage is that the torsion bar is not a complete solution to eradicate torsion spikes arising from stick-slip. The torsion bar absorbs some torsion energy and smoothes out radical changes (spikes) in torque. The torsion spikes arising from highly violent stick-slip events may still damage fragile components and electronics even in the presence of a torsion bar. For each individual deployment of a torsion bar, therefore, the advantage of torsion spike remediation (and associated protection of fragile components and electronics) must outweigh the attendant disadvantages.

The foregoing has rather broadly outlined some features and technical advantages of the disclosed pressure compensator assembly, thrust bearing and torsion bar, in order that the following detailed description may be better understood. Additional features and advantages of the disclosed technology may be described. It should be appreciated by those skilled in the art that the conception and the specific embodiments disclosed may be readily utilized as a basis for modifying or designing other structures for carrying out the same inventive purposes of the disclosed technology, and that these equivalent constructions do not depart from the spirit and scope of the technology as described.

BRIEF DESCRIPTION OF THE DRAWINGS

For a more complete understanding of the embodiments described in this disclosure, and their advantages, reference is made to the following detailed description taken in conjunction with the accompanying drawings, in which.

DETAILED DESCRIPTION

Reference is now made to FIGS. 3 through 10 in describing the currently preferred embodiments of the disclosed new compensator assembly, servo assembly and torsion bar, and their related features. For the purposes of the following disclosure, FIGS. 3 through 10 should be viewed together. Any part, item, or feature that is identified by part number on one of FIGS. 3 through 10 will have the same part number when illustrated on another of FIGS. 3 through 10. It will be understood that the embodiments as illustrated and described with respect to FIGS. 3 through 10 are exemplary, and the scope of the inventive material set forth in this disclosure is not limited to such illustrated and described embodiments.

Figure 3:
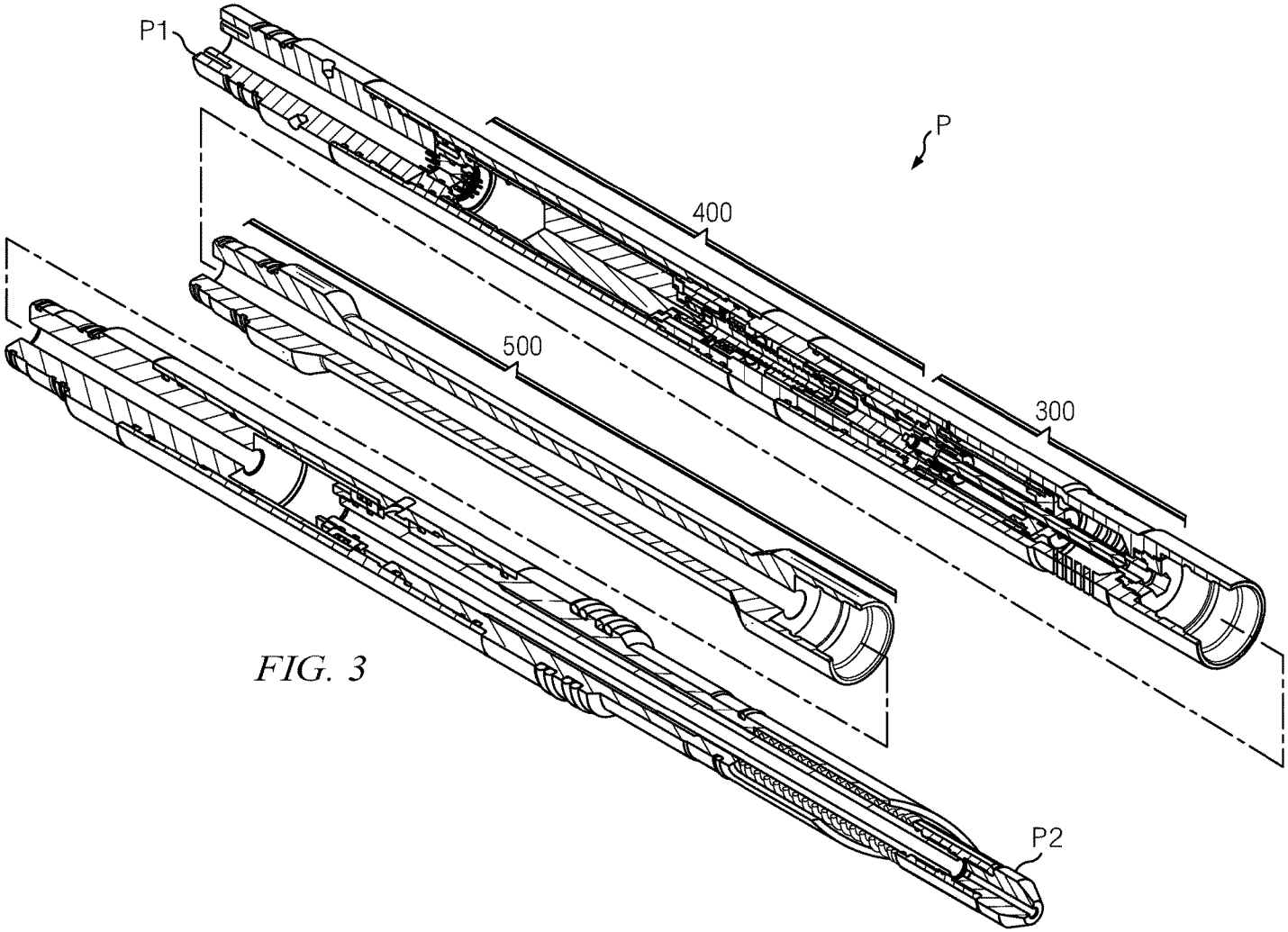
FIG. 3 illustrates an embodiment of servo-driven mud pulser assembly P including embodiments of compensator assembly 300, servo assembly 400 and torsion bar 500 according to this disclosure.

FIG. 3 illustrates an embodiment of servo-driven mud pulser assembly P including embodiments of compensator assembly 300, servo assembly 400 and torsion bar 500 according to this disclosure. Pulser end P1 is oriented towards the surface in a drill string, and pulser end P2 is oriented towards the bit. It will be understood that in typical deployments, MWD equipment will be located immediately nearby and above pulser end P1 towards the surface. With continuing reference to FIG. 3, the disclosed embodiment of pulser assembly P positions servo assembly 400 near pulser end P1, with compensator assembly 300 and torsion bar 500 connected to servo assembly in sequence towards pulser end P2.

Figure 4:
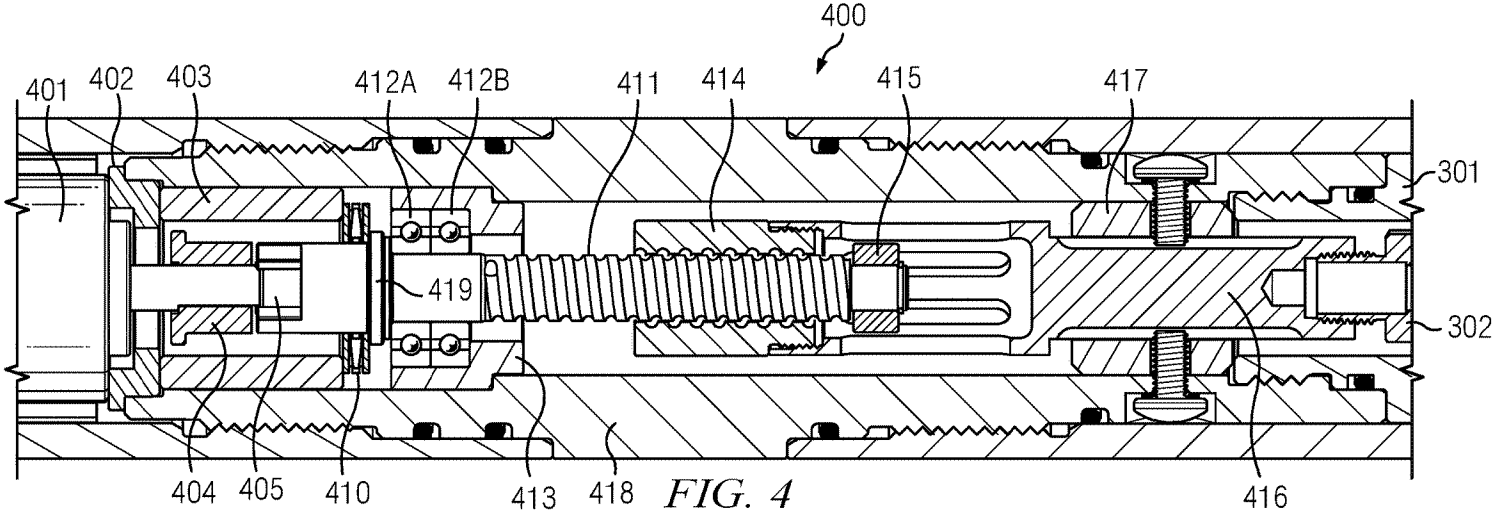
FIG. 4 illustrates a section through an embodiment of servo assembly 400.
Figure 6:
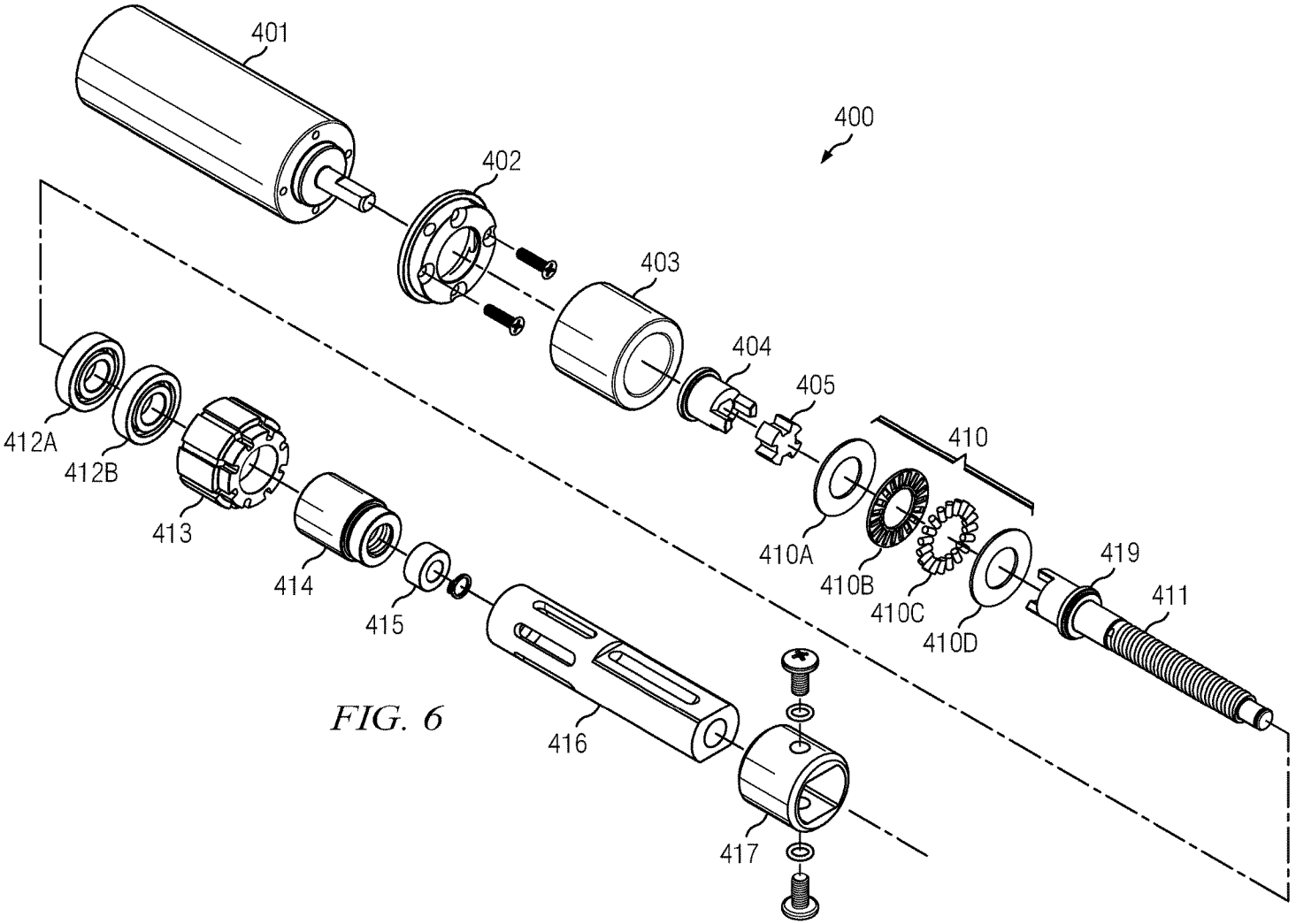
FIG. 6 is an exploded view of servo assembly 400.

FIG. 4 is a section through an embodiment of servo assembly 400. FIG. 6 is an exploded view of servo assembly 400. FIGS. 4 and 6 should be viewed together for purposes of the following detailed description of a currently preferred embodiment of servo assembly 400.

Referring to FIGS. 4 and 6, face plate 402 is rigidly connected to the housing of servo motor 401 via screws or other suitable fasteners. The rotor of servo motor 401 rotates lead screw 411 via a rotational linkage that includes coupling 404 and spider coupling 405. In some embodiments, spider coupling 405 may be made from a nonmetallic material, such as a polymer, and provides electrical insulation between the rotor of motor 401 and lead screw 411. In other embodiments, spider coupling 405 may be made from a resilient material, such as an elastomer, providing the linkage between the rotor of motor 401 and lead screw 411 some limited dampening of torsion spikes when motor 401 changes rotation direction.

Ball nut 414 is threadably engaged onto lead screw 411, and is held in place on lead screw 411 by snap ring and collar 415. Ball nut 414 is further connected to anti-rotation shaft 416 and anti-rotation bushing 417. Anti-rotation shaft and bushing 416/417 cooperate to prevent ball nut 414 from rotating, so that rotation of lead screw 411 in opposing directions causes corresponding reciprocating displacement of ball nut 414 (and components to which ball nut 414 is attached) as described further below.

Bearings 412A and 412B are received over a distal end of lead screw 411. Bearing 412A and 412B bear against lead screw shoulder 419 on lead screw 411. Bearing housing 413 holds bearings 412A and 412B in place between lead screw shoulder 419 on lead screw 411 and servo assembly housing 418. Bearings 412A and 412B cooperate with bearing housing 413 to enable free rotation of lead screw 411 about the axial centerline of servo assembly housing 418.

Thrust bearing 410 is received over a proximal end of lead screw 411 and also bears against lead screw shoulder 419 on lead screw 411. In currently preferred embodiments, with particular reference now to FIG. 6, thrust bearing 410 comprises retaining elements 410A and 410D holding thrust bearing race 410B and cylindrical bearings 410C together in a unitary assembly. Referring now to FIG. 4, thrust spacer 403 is interposed between thrust bearing 410 and face plate 402. It will be recalled from earlier description that face plate 402 is rigidly connected to the housing of servo motor 401. Thrust spacer 403 thus does not rotate since it bears upon face plate 402. Thrust bearing 410 thus enables free rotation of lead screw 411 with respect to thrust spacer 403, since thrust bearing 410 is interposed between lead screw shoulder 419 on lead screw 414 and thrust spacer 403.

Figure 8A:
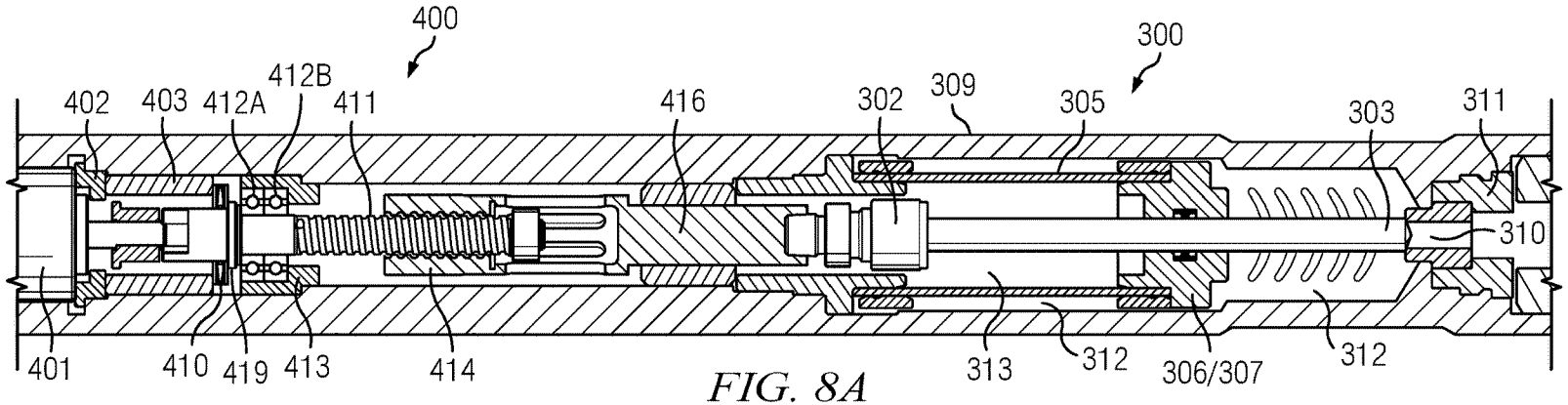
FIGS. 8A and 8B illustrate servo assembly 400 and compensator assembly 300 each in two different modes of operation, each assembly operating independently.
Figure 8B:
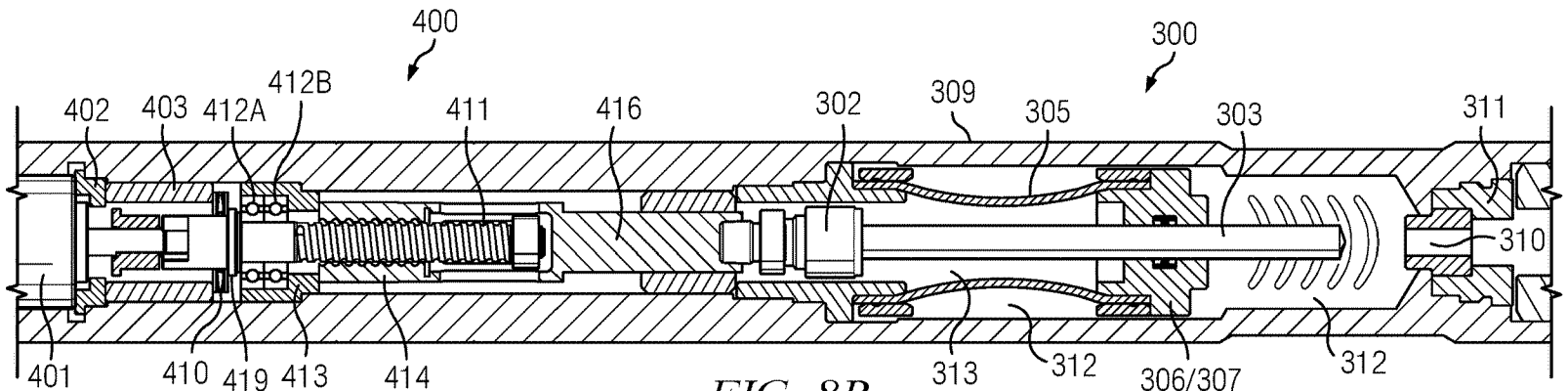

FIGS. 4 and 6, and now FIGS. 8A and 8B should be viewed together for an understanding of how thrust bearing 410 operates to provide robust dampening of the reactive energy generated in servo assembly 400 when the servo motor 401 stalls to change direction. It will be recalled from earlier disclosure and from FIG. 10 that controls associated with servo motor 401 detect current spikes when servo motor 401 stalls as a fully open or closed position for servo assembly 400 is reached. Servo motor 401 changes direction of rotation responsive to detection of these current spikes.

FIGS. 8A and 8B illustrate such fully open and fully closed positions of servo assembly 400. FIG. 8A illustrates a fully closed mode and FIG. 8B illustrates a fully open mode. It should be noted that FIGS. 8A and 8B also illustrate operation of compensator assembly 300, and that two different modes of compensator assembly 300 are shown on each of FIGS. 8A and 8B. It should be further noted that the modes of servo assembly 400 illustrated on FIGS. 8A and 8B are not interdependent on the modes of compensator assembly 300 also illustrated on FIGS. 8A and 8B. The operational modalities of servo assembly 400 and compensator assembly 300 as described in this disclosure are independent of one another.

It will be seen on FIGS. 8A and 8B that anti-rotation shaft 416 is rigidly connected to pulser shaft 303 via tubing adapter 302. On FIG. 8A, rotation of lead screw 411 by motor 401 has displaced pulser shaft 303 fully into orifice 310 in servo valve 311, to the point where continued movement of pulser shaft 303 into orifice 310 will cause motor 401 to stall. Detection of a current spike associated with this stall causes controls over motor 401 to rotate motor 401 in the other direction. Such change in rotational direction of motor 401 causes lead screw 411 to rotate in the other direction, whereupon pulser shaft 303 commences retraction from orifice 310. Referring now to FIG. 8B, pulser shaft 303 continues to retract until ball nut 414 contacts bearing bushing 413, at which point ball nut 414 can travel no further and motor 401 stalls again. Detection of a current spike associated with this new stall causes controls over motor 401 to rotate motor 401 in the other direction. Such change in rotation of motor 401 causes lead screw 411 to rotate in the other direction, whereupon pulser shaft 303 commences extension back towards orifice 310.

It will be recalled from description in the "Background" section above that the repetitive stalls of motor 401 associated with operation of servo assembly 400 can have damaging effects on the motor 401. A reactive energy in the form of a concussive spike is created and transmitted back through the servo assembly 400 every time the motor 401 stalls and changes direction.

Thrust bearing 410, as illustrated on FIGS. 4, 6, 8A and 8B, directs this reactive energy into the housing of motor 401. Thrust bearing 410 absorbs the reactive energy via snug contact with lead screw shoulder 419 on lead screw 411, and transmits the reactive energy into the housing of motor 401 via snug contact with thrust spacer 403 and face plate 402.

The disclosed design including thrust bearing 410 is thus in contrast to prior art designs which, as noted in the "Background" section, have attempted to absorb the reactive energy by inserting dampening elements in the linkage between the rotor of motor 401 and lead screw 411. It will be appreciated that the housing of servo motor 401 is a relatively strong component that is far abler to absorb concussive spikes of reactive energy than the rotor. Additionally, absorption of the reactive energy by the housing tends to insulate the rotor (and its connected parts inside motor 401, including planetary gears) from the reactive energy. Further, thrust bearing 410 is a wide diameter component with more surface area than a dampening element in the rotor linkage. The reactive energy is thus absorbed as a lower overall stress per unit surface area. As a result, the service life of motor 401 is dramatically improved.

FIGS. 4, 6 8A and 8B illustrate currently preferred embodiment of a deployment of thrust bearing 410. Other, non-illustrated embodiments within the scope of this disclosure include omitting thrust bearing 410 and using thrust spacer 403 by itself to direct the reactive energy into the housing of motor 401. In such embodiments, thrust spacer 403 may have to be longer and include rotary bearing features. Other, non-illustrated embodiments within the scope of this disclosure include incorporating a thrust bearing directly into a servo motor 401 assembly. Current designs of servo motors deploy a retaining ring between the rotor and the outside of the housing as the rotor exits the housing. According to non-illustrated embodiments of this disclosure, the retaining ring may be replaced with a thrust bearing. The thrust bearing in such non-illustrated embodiments may then divert reactive energy received by the rotor immediately into the motor housing.

Figure 5:
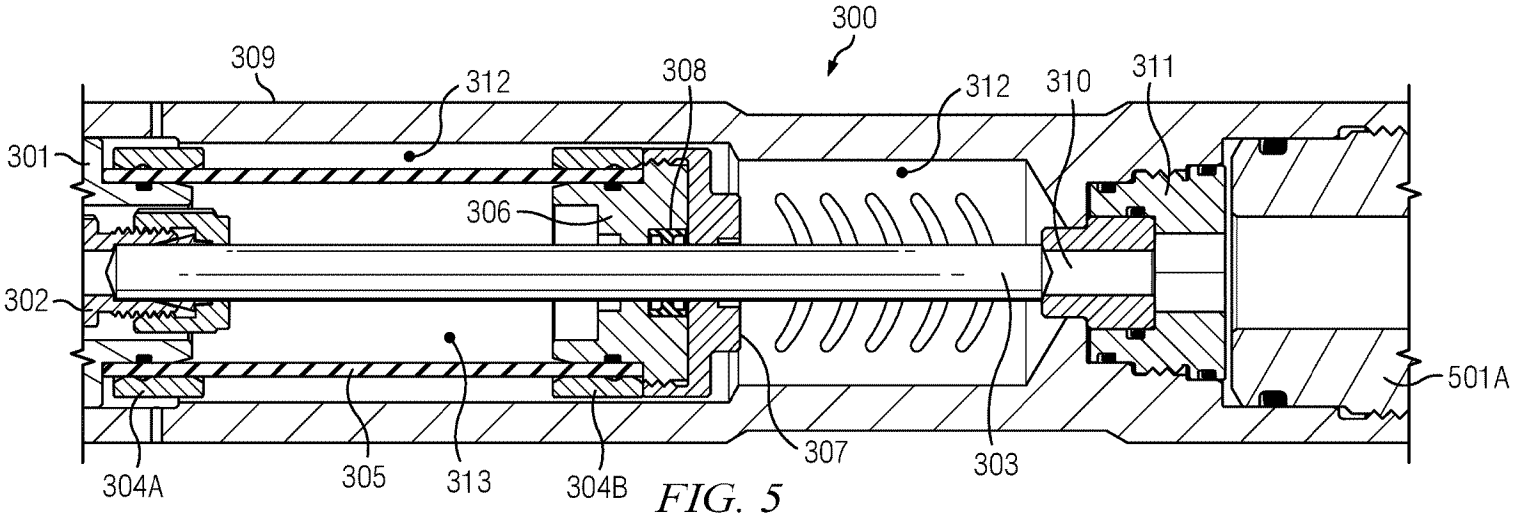
FIG. 5 illustrates a section through an embodiment of compensator assembly 300.
Figure 7:
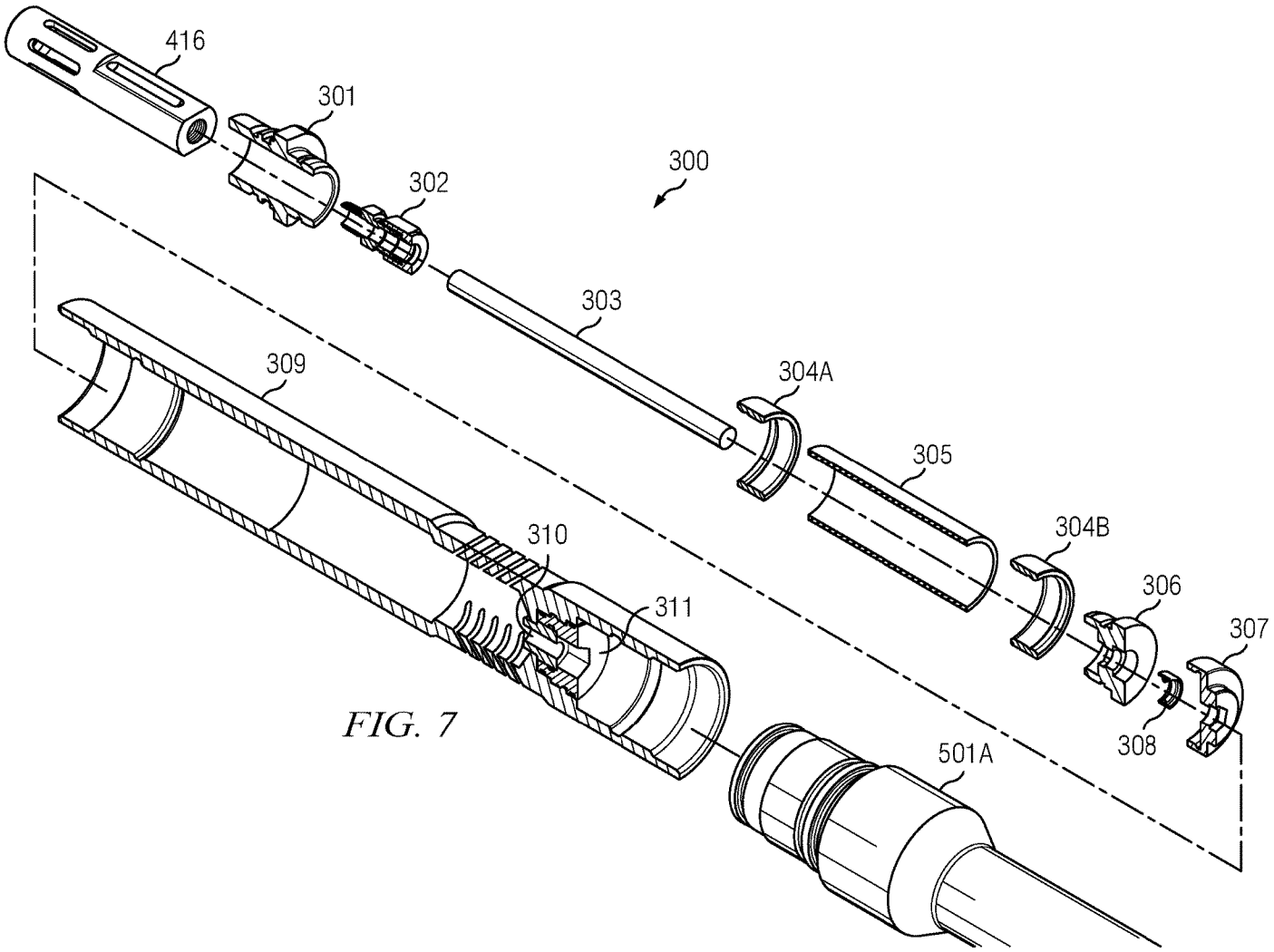
FIG. 7 is an exploded view of compensator assembly 300.

FIG. 5 is a section through an embodiment of compensator assembly 300. FIG. 7 is an exploded view of compensator assembly 300. FIGS. 5 and 7 should be viewed together for purposes of the following detailed description of a currently preferred embodiment of compensator assembly 300.

Referring to FIGS. 5 and 7, and as noted above in the description of servo assembly 400, anti-rotation shaft 416 on servo assembly 400 is rigidly connected to pulser shaft 303 via tubing adapter 302. Tubing adapter 302 is received into seal base 301. A proximal end of generally tubular compensator sleeve 305 is received over pulser shaft 303 and then over a distal end of seal base 301. Seal ring 304A sealingly affixes compensator sleeve 305 to seal base 301.

Seal cap 306 is then received over pulser shaft 303. Dynamic seal 308 (preferably at least one o-ring) seals seal cap 306 around pulser shaft 303, so that seal cap may displace along pulser shaft 303 while dynamic seal 308 maintains a seal around pulser shaft 303. Dynamic seal 308 further allows pulser shaft 303 to reciprocate freely through seal cap 306 maintaining seal around pulser shaft 303. A distal end of compensator sleeve 305 is received over seal cap 306. Seal ring 304B sealingly affixes compensator sleeve 305 to seal cap 306. Jam nut 307 is then received over pulser shaft 303 and rigidly connects to seal cap 306 (e.g. by threaded engagement) to ensure that dynamic seal 308 remains in place during sliding displacement of seal cap 306 along pulser shaft 303.

It will thus be appreciated from FIG. 5 that oil chamber 313 is created inside compensator sleeve 305. Seal rings 304A/304B cooperate with dynamic seal 308 to isolate oil in oil chamber 313 from possible commingling with drilling fluid 312 found in the annular space between compensator sleeve 305 and screen housing 309, and in the screen housing area around servo valve 311.

Figure 1:
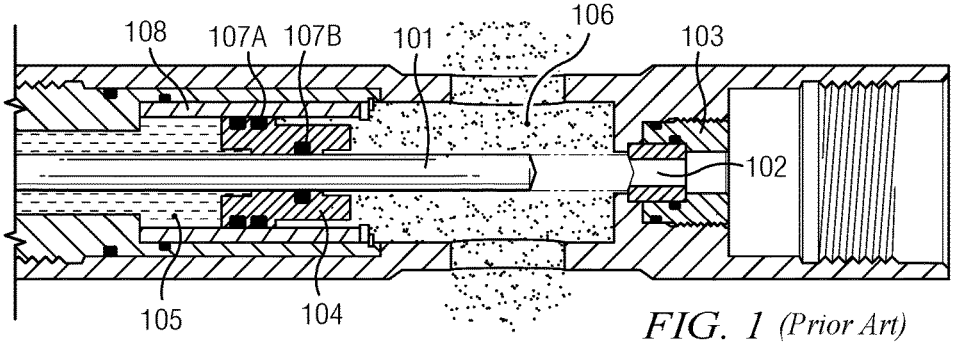
FIG. 1 (Prior Art)
FIG. 1 illustrates an example of a prior art piston-sleeve design of compensator assembly as described above in the "Background" section.
Figure 2A:
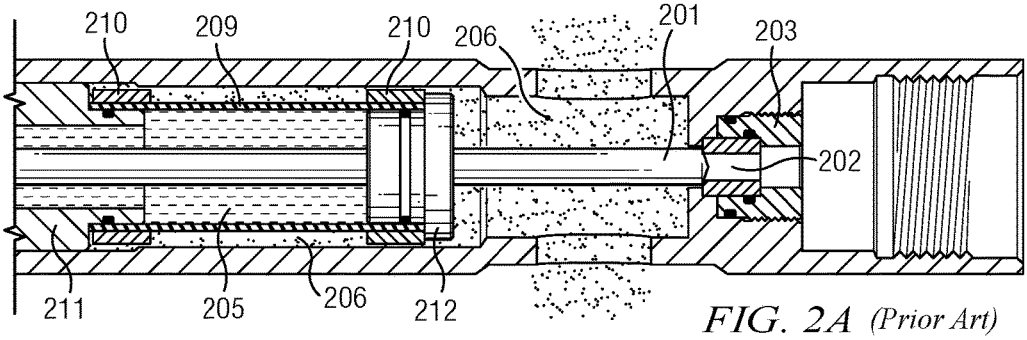
FIG. 2A (Prior Art)
FIGS. 2A and 2B illustrate an example of a prior art accordion-bladder design of compensator assembly as described above in the "Background" section.
Figure 2B:
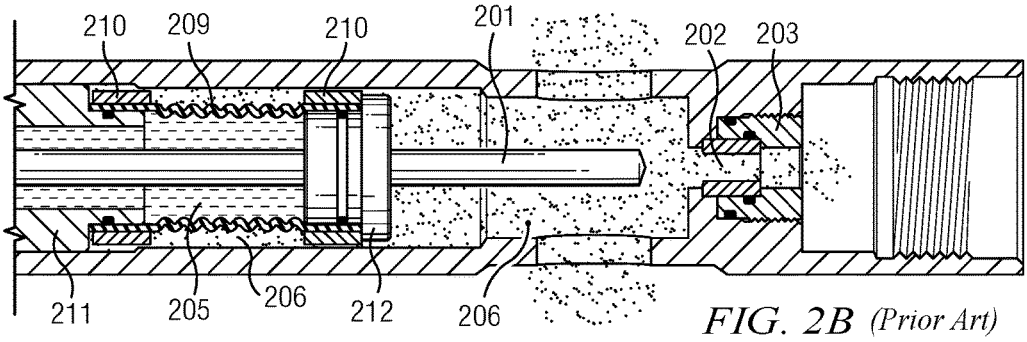
FIG. 2B (Prior Art)

FIGS. 5 and 7, and now FIGS. 8A and 8B should be viewed together for an understanding of how compensator assembly 300 operates to provide more robust, dependable, long-life pressure compensation than has been seen in the prior art, such as described in the "Background" section above with reference to FIGS. 1, 2A and 2B.

FIGS. 8A and 8B illustrate two modes of compensator assembly 300 response to differing temperatures/pressures of drilling fluid 312 experienced around servo valve 311. FIG. 8A illustrates a lower temperature/pressure and FIG. 8B illustrates a higher temperature/pressure. It should be noted that FIGS. 8A and 8B also illustrate operation of servo assembly 400, and that two different modes of servo assembly 400 are shown on each of FIGS. 8A and 8B. It should be further noted that the modes of compensator assembly 300 illustrated on FIGS. 8A and 8B are not interdependent on the modes of servo assembly 400 also illustrated on FIGS. 8A and 8B. The operational modalities of compensator assembly 300 and servo assembly 400 as described in this disclosure are independent of one another.

It will be seen on FIG. 8B that, in comparison to FIG. 8A, the higher temperature/pressure of drilling fluid 312 on FIG. 8B has caused compensator sleeve 305 to contract radially. Seal cap 306, dynamic seal 308 and jam nut 307 on FIG. 8B have displaced along pulser shaft 303 accordingly. Oil inside oil chamber 313 nonetheless remains scaled off from possible commingling with drilling fluid 312 in the annular space between compensator sleeve 305 and screen housing 309, and in the screen housing area around servo valve 311.

The design of FIGS. 5, 7, 8A and 8B thus improves over prior art designs. Compensator sleeve 305 is free to expand or contract ("inflate" or "deflate") in response to changing pressure temperature differentials across compensator sleeve 305. Contrary to the existing designs depicted in FIGS. 2A and 2B, however, compensator sleeve 305 will not "accordion" as pulser shaft 303 reciprocates. Instead, compensator sleeve 305 will inflate and deflate, respectively. Some inflation or deflation of compensator sleeve 305 will arise in response to temperature or volume changes inside oil chamber 313 caused by movement of the pulser shaft 303. Other displacement of compensator sleeve 305 will arise in response to compensation for pressure differentials across compensator sleeve 305 in response to pressure and temperature changes in the drilling fluid 312 with respect to the oil in oil chamber 313, or vice versa. As a result, compensator sleeve 305, being generally cylindrical, may be manufactured to have a thicker wall thickness than a corresponding accordion-style bladder such as depicted on FIGS. 2A and 2B. Such thicker wall thickness may be expected to provide improved service life and reliability overall for compensator assembly 300.

Further, in the design illustrated on FIGS. 8A and 8B, the assembly of seal cap 306, dynamic seal 307 and jam nut 307 "floats" on pulser shaft 303, making small displacements back and forth along pulser shaft 303 as compensator sleeve 305 inflates and deflates. These small displacements compare favorably to the compensating piston design illustrated on FIG. 1, in which pressure compensation is enabled substantially entirely by movement of the piston. The design illustrated on FIGS. 8A and 8B thus provides for considerably less movement of pulser shaft 303 through dynamic seal 308 than comparatively on FIG. 1. As a result, dynamic seal 308 may be expected to last longer, and be more reliable against leakage than comparatively on FIG. 1. Similarly, pulser shaft 303 in the design illustrated on FIGS. 8A and 8B may be expected to be less prone to sticking in seal 308, especially in the presence of solids in drilling fluid 312. Furthermore, the design illustrated on FIGS. 8A and 8B is less prone to solids buildup around the assembly of seal cap 306, dynamic seal 307 and jam nut 307 than in the corresponding compensating piston-sleeve arrangement in the prior art design depicted on FIG. 1. As a result, the assembly of seal cap 306, dynamic seal 307 and jam nut 307 may be expected to float dependably along pulser 303 during service and not lock up, remaining relatively free from obstruction by accumulated solids nearby.

The scope of this disclosure contemplates multiple alternative embodiments for manufacturing a compensator assembly 300 according to FIGS. 5, 7, 8A and 8B. The assembly of seal cap 306, dynamic seal 308 and jam nut 307 may be made of fewer or more components to assist with installation and replacement of dynamic seal 308. Seal rings 304A and 304B may enable their respective seals of by crimping or adhesive. Alternatively, compensator sleeve 305 may be molded to seal base 301 and/or seal cap 306, obviating the need for seal rings 304A and 304B. Alternatively, compensator sleeve 305 and the assembly of seal cap 306, dynamic seal 308 and jam nut 307 may be made from a unitary piece of elastomer or other rubber-like material, so that the unitary piece may simultaneously function as seal cap 306, and the dynamic seal 308 on the pulser shaft 303. Alternatively, instead of a floating assembly, the assembly of seal cap 306, dynamic seal 308 and jam nut 307 may be an extended piece that spans the length of the compensator sleeve 305 and rigidly connects (e.g. threads) into seal base 301, thereby holding the ends of the compensator sleeve 305 rigid while the compensator sleeve 305 is free to inflate or deflate.

Figure 9:
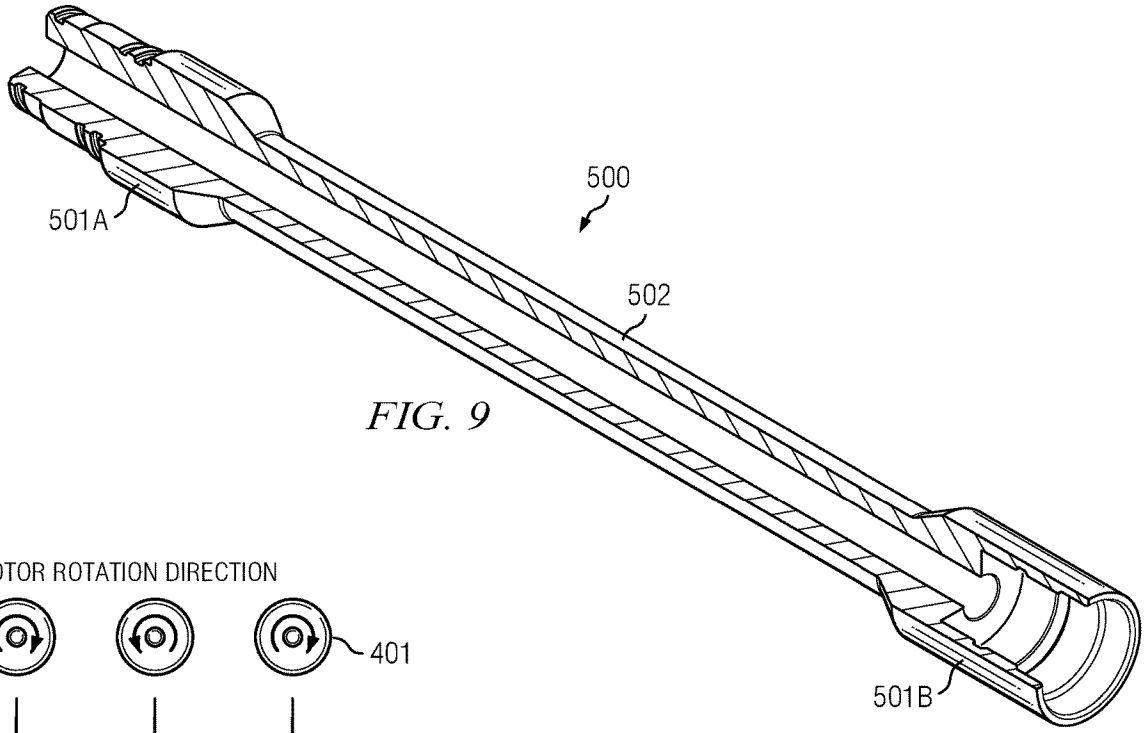
FIG. 9 illustrates a section through an embodiment of torsion bar 500.
Figure 10:
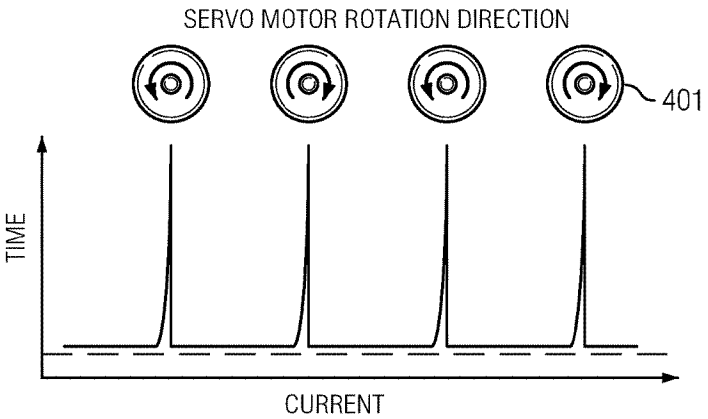
FIG. 10 illustrates schematically the alternating reversal of direction of operation of servo motor 401 responsive to supply current spikes, as described in this disclosure.

FIG. 9 is a section through an embodiment of torsion bar 500. In preferred embodiments, torsion bar 500 is an elongate hollow body with servo motor end 501A and pulser end 501B. Torsion bar 500 also provides reduced diameter portion 502. In the embodiment illustrated on FIG. 9, reduced diameter portion 502 is provided over substantially the entire length of torsion bar 500. The scope of this disclosure is not limited in this regard, and other non-illustrated embodiments of torsion bar 500 may provide reduced diameter portion 502 on less than substantially the entire length of torsion bar 500. Further, reduced diameter portion 502 on FIG. 9 is illustrated as having substantially a uniform outside diameter. The scope of this disclosure is not limited in this regard, and other non-illustrated embodiments of torsion bar 500 may provide reduced diameter portion 502 with varying outside diameters. Further, torsion bar 500 is illustrated on FIG. 9 as having an interior "tunnel" (for drilling fluid flow) whose internal diameter is uniform over the entire length of torsion bar 500. The scope of this disclosure is not limited in this regard, and other non-illustrated embodiments of torsion bar 500 may provide interior tunnel with varying internal diameters. Care should be exercised on this last design point, however, not to reduce the internal tunnel diameter so much that torsion bar 500 constricts the required drilling fluid flow through the drill string.

As seen also with reference to FIG. 3, torsion bar 500 is positioned in mud pulser assembly P between (1) fragile components such as MWD equipment, servo assembly 400 and compensator assembly 300, and (2) BHA components nearer the bit where stick/slip events are likely to occur. In this way, torsion bar 500 is positioned to protect such fragile components by dampening torsion spikes from stick-slip events, especially those occurring nearer the bit.

It will be understood that embodiments of torsion bar 500 may be made from a different, softer, and/or more resilient material than the hard metal (often stainless steel) of which drill string collar is typically made. The hard metal drill collar is a good transmitter of torsion spikes from stick-slip events. Embodiments of torsion bar 500 made, at least in part, from a softer, more resilient material (such as, for example, softer ferrous metals, or possibly aluminum or a synthetic polymer) absorb torsion spikes and smooth out large changes in torsion stress caused by stick/slip events.

Likewise reduced diameter portion 502 gives torsion bar 500 greater torsional resilience to absorb torsion spikes and smooth out large changes in torsion stress caused by stick/slip events. Indeed, torsion bar 500's dimensions may be designed, in combination with material selection, into a specification to remediate specific torsion spikes values anticipated downhole on a particular drilling job. For example, length of torsion bar 500, length and diameter of reduced diameter portion 503, and internal diameter of torsion bar 500 are all dimension parameters that may be customized, along with material selection, to design a specification to achieve desired results.

The performance of an exemplary torsion bar 500 may be theorized as follows:

$$\theta = \frac{LT}{GJ}$$

where:

θ=Angular Deflection of a body along its longitudinal axis

L=Length of Body

T=Torsional Moment

G=Shear Modulus which is determined by the material of the body

J=Polar Moment of Inertia

The exemplary torsion bar 500 manipulates the value of the variable J, for which the formula is described below for a circular cross section:

$$J = \frac{1}{32} \times D^4$$

where:

D=Outside Diameter of the body

Since J is a function of the diameter to the fourth power, a small decrease of the value of D can result in a much larger decrease in the value of J, and a subsequent large increase in the angular deflection. For example, if D is decreased to ½ of its original value, then J will decrease to 1/16 of its original value. If all other values remain equal, this results in the body with decreased diameter deflecting 16× more than the original body.

Applied to torsion bar 500, reduced diameter portion 502 of torsion bar 500 has a reduced value of D which increases angular deflection of torsion bar 500 geometrically for a given torsional force. As a result, a torsion bar 500 of a given length becomes geometrically more efficient at smoothing out torsion spikes from stick-slip events.

The scope of this disclosure contemplates other alternative embodiments to torsion bar in addition to those already described and illustrated. For example, portions (if not all) of torsion bar 500 could be replaced with a torsion spring.

Although the inventive material in this disclosure has been described with reference to detailed embodiments, some of their technical advantages, and the following claims, it will be understood that various changes, amendments, substitutions and alterations may be made to the detailed embodiments and the claims without departing from the broader spirit and scope of such inventive material.

We claim:

1. A compensator assembly in a downhole servo motor assembly, the compensator assembly comprising:

a servo motor including a rotor and a motor housing, the servo motor received inside an elongate and tubular screen housing;

a pulser shaft also received inside the screen housing, wherein rotation of the rotor in alternating directions causes corresponding reciprocating motion of the pulser shaft parallel to a longitudinal axis of the screen housing;

a seal base also received inside the screen housing, the seal base received over the pulser shaft and affixed rigidly and sealingly to an interior wall of the screen housing;

a compensator sleeve also received inside the screen housing, the compensator sleeve received over the pulser shaft;

a seal cap also received inside the screen housing, the seal cap received over the pulser shaft, a dynamic seal also received over the pulser shaft and interposed between the seal cap and the pulser shaft such that the dynamic seal permits sealed sliding displacement between the seal cap and the pulser shaft;

wherein a first end of the compensator sleeve is affixed sealingly to the seal base and a second end of the compensator sleeve is affixed sealingly to the seal cap such that an annular space is created between the compensator sleeve and the interior wall of the screen housing;

wherein an oil chamber is bounded at least in part by the compensator sleeve and the seal cap, wherein oil in the oil chamber is sealed from commingling with at least (1) drilling fluid in the annular space, and (2) drilling fluid in a cavity sealed off from the oil chamber by the dynamic seal;

wherein, responsive to pressure differential across the compensator sleeve between oil in the oil chamber and drilling fluid in the annular space and the cavity, the compensator sleeve contracts and expands in a radial direction perpendicular to the longitudinal axis of the screen housing; and wherein, responsive to said contraction and expansion of the compensator sleeve, the seal cap displaces along the pulser shaft while the oil chamber remains sealed during said seal cap displacement by the dynamic seal.

2. The compensator assembly of claim 1, further comprising a jam nut, the jam nut received over the pulser shaft, the jam nut rigidly affixed to the seal cap such that the jam nut and the seal cap cooperate to retain the dynamic seal.

3. The compensator assembly of claim 1, further comprising a first sealing ring, the first sealing ring sealing the first end of the compensator sleeve to the seal base.

4. The compensator assembly of claim 3, in which the first sealing ring seals the first end of the compensator sleeve to the seal base via a sealing technique selected from the group consisting of (1) crimping, and (2) adhesive.

5. The compensator assembly of claim 1, further comprising a second sealing ring, the second sealing ring sealing the second end of the compensator sleeve to the seal cap.

6. The compensator assembly of claim 5, in which the second sealing ring seals the second end of the compensator sleeve to the seal cap via a sealing technique selected from the group consisting of (1) crimping, and (2) adhesive.

7. The compensator assembly of claim 1, in which the compensator sleeve is molded to at least one of the seal cap and the seal base.

8. The compensator assembly of claim 1, further comprising:

a lead screw, the lead screw rotationally connected to the rotor within the screen housing, the lead screw providing an annular lead screw shoulder;

a ball nut, the ball nut threadably engaged on the lead screw, the ball nut restrained from rotation with respect to the screen housing, the pulser shaft rigidly affixed to the ball nut at a first shaft end;

a servo valve including an orifice, a second shaft end of the pulser shaft disposed to be received into the orifice;

wherein said reciprocating motion of the pulser shaft is bounded by contact of the ball nut ultimately against the lead screw shoulder when the servo valve is fully open, and by contact of the second shaft end against the orifice when the servo valve is fully closed;

wherein reactive energy is created from stalls of the servo motor, the stalls occurring when ball nut ultimately contacts the lead screw shoulder and when the second shaft end contacts the orifice;

a thrust spacer and a thrust bearing, the thrust spacer and thrust bearing interposed between the lead screw shoulder and the motor housing such that the lead screw shoulder ultimately contacts the motor housing via at least the thrust spacer and thrust bearing;

wherein the thrust spacer and thrust bearing divert the reactive energy into the motor housing.

9. The compensator assembly of claim 8, in which a bearing housing and at least one bearing is interposed between the lead screw shoulder and the ball nut such that the ball nut ultimately makes contact against the lead screw shoulder via the bearing housing and the at least one bearing.

10. The compensator assembly of claim 8, in which a face plate is attached to the motor housing such that the lead screw shoulder ultimately contacts the motor housing via at least the thrust spacer, the thrust bearing and the face plate.

11. The compensator assembly of claim 8, in which said rigid affixation of the pulser shaft to the ball nut at a first shaft end is via a tubing adaptor.

12. A drill string section, the drill string section including a drill collar, the drill string further comprising:

measurement-while-drilling (MWD) equipment;

a servo motor including a rotor and a motor housing, the servo motor received inside an elongate and tubular screen housing;

a pulser shaft also received inside the screen housing, wherein rotation of the rotor in alternating directions causes corresponding reciprocating motion of the pulser shaft parallel to a longitudinal axis of the screen housing;

a seal base also received inside the screen housing, the seal base received over the pulser shaft and affixed rigidly and sealingly to an interior wall of the screen housing;

a compensator sleeve also received inside the screen housing, the compensator sleeve received over the pulser shaft;

a seal cap also received inside the screen housing, the seal cap received over the pulser shaft, a dynamic seal also received over the pulser shaft and interposed between the seal cap and the pulser shaft such that the dynamic seal permits sealed sliding displacement between the seal cap and the pulser shaft;

wherein a first end of the compensator sleeve is affixed sealingly to the seal base and a second end of the compensator sleeve is affixed sealingly to the seal cap such that an annular space is created between the compensator sleeve and the interior wall of the screen housing;

wherein an oil chamber is bounded at least in part by the compensator sleeve and the seal cap, wherein oil in the oil chamber is sealed from commingling with at least (1) drilling fluid in the annular space, and (2) drilling fluid in a cavity sealed off from the oil chamber by the dynamic seal;

wherein, responsive to pressure differential across the compensator sleeve between oil in the oil chamber and drilling fluid in the annular space and the cavity, the compensator sleeve contracts and expands in a radial direction perpendicular to the longitudinal axis of the screen housing;

wherein, responsive to said contraction and expansion of the compensator sleeve, the seal cap displaces along the pulser shaft while the oil chamber remains sealed during said seal cap displacement by the dynamic seal; and an elongate and tubular torsion bar inserted in the drill string, the torsion bar having (a) a length, (b) an external diameter, and (c) an internal diameter, the torsion bar further comprising at least one feature from the group consisting of:

(1) the torsion bar comprises a softer material than used to form the drill collar; and (2) the torsion bar's length provides a reduced diameter portion thereof, the reduced diameter portion having a reduced external diameter.

13. The drill string section of claim 12, further comprising:

a lead screw, the lead screw rotationally connected to the rotor within the screen housing, the lead screw providing an annular lead screw shoulder;

a ball nut, the ball nut threadably engaged on the lead screw, the ball nut restrained from rotation with respect to the screen housing, the pulser shaft rigidly affixed to the ball nut at a first shaft end;

a servo valve including an orifice, a second shaft end of the pulser shaft disposed to be received into the orifice;

wherein said reciprocating motion of the pulser shaft is bounded by contact of the ball nut ultimately against the lead screw shoulder when the servo valve is fully open, and by contact of the second shaft end against the orifice when the servo valve is fully closed;

wherein reactive energy is created from stalls of the servo motor, the stalls occurring when ball nut ultimately contacts the lead screw shoulder and when the second shaft end contacts the orifice;

a thrust spacer and a thrust bearing, the thrust spacer and thrust bearing interposed between the lead screw shoulder and the motor housing such that the lead screw shoulder ultimately contacts the motor housing via at least the thrust spacer and thrust bearing;

wherein the thrust spacer and thrust bearing divert the reactive energy into the motor housing.

14. The drill string section of claim 12, in which the reduced diameter portion has a varying reduced external diameter.

15. The drill string section of claim 12, in which portions of the torsion bar comprise a softer material than used to form the drill collar.

16. The drill string section of claim 12, in which the torsion bar has a varying internal diameter.

* * * * *